US009968947B2

(12) United States Patent
Pieralisi

(10) Patent No.: US 9,968,947 B2
(45) Date of Patent: May 15, 2018

(54) CENTRIFUGAL SEPARATOR OR DECANTER HAVING AN ELECTROMAGNETIC CLOSING SYSTEM

(71) Applicant: PIERALISI MAIP SOCIETA' PER AZIONI, Jesi (IT)

(72) Inventor: Gennaro Pieralisi, Jesi (AN) (IT)

(73) Assignee: PIERALISI MAIP SOCIETA' PER AZIONI, Jesi (AN) (IT)

( * ) Notice: Subject to any disclaimer, the term of this patent is extended or adjusted under 35 U.S.C. 154(b) by 671 days.

(21) Appl. No.: 14/412,573

(22) PCT Filed: Jun. 26, 2013

(86) PCT No.: PCT/EP2013/063445

§ 371 (c)(1),
(2) Date: Jan. 2, 2015

(87) PCT Pub. No.: WO2014/009161

PCT Pub. Date: Jan. 16, 2014

(65) Prior Publication Data

US 2015/0190817 A1 Jul. 9, 2015

(30) Foreign Application Priority Data

Jul. 12, 2012 (IT) ..... AN2012A0088

(51) Int. Cl.
*B04B 1/10* (2006.01)
*B04B 1/14* (2006.01)
(Continued)

(52) U.S. Cl.
CPC ..... *B04B 11/05* (2013.01); *B04B 1/10* (2013.01); *B04B 1/14* (2013.01); *B04B 1/20* (2013.01);
(Continued)

(58) Field of Classification Search
CPC ..... B04B 11/05; B04B 11/02; B04B 1/10; B04B 1/14; B04B 11/04; B04B 1/20;
(Continued)

(56) References Cited

U.S. PATENT DOCUMENTS 3,403,849 A 10/1968 Thylefors
3,712,535 A * 1/1973 Genese ..... B01L 3/0206 422/921
(Continued)

FOREIGN PATENT DOCUMENTS

DE 3129102 A1 * 2/1983 ..... B04B 7/08
ES 8600703 A1 2/1986
(Continued)

OTHER PUBLICATIONS

International Search Report for corresponding International Application No. PCT/EP2013/063445.

*Primary Examiner* — Charles Cooley
(74) *Attorney, Agent, or Firm* — Egbert Law Offices, PLLC

(57) ABSTRACT

A centrifugal separator has a rotary drum that is adapted to receive a product that can be separated into a light phase, a heavy phase, and solid sediments, a first outlet for the light phase, a closing device that opens and closes a second outlet for the heavy phase. The closing device has an electromagnetic actuator having a ferromagnetic element whereon a closing plug is mounted. The electromagnetic actuator has an electromagnetic coil that creates a magnetic field so as to attract the ferromagnetic element. A spring is connected to the closing plug so as to urge the closing plug to a closed position. The closing plug, the ferromagnetic element and the spring are connected to the rotary drum.

7 Claims, 13 Drawing Sheets

(51) Int. Cl.

| | |
|---|---|
| ***B04B 11/04*** | (2006.01) |
| ***B04B 11/05*** | (2006.01) |
| ***B04B 1/20*** | (2006.01) |
| ***B04B 11/02*** | (2006.01) |

(52) U.S. Cl.
CPC ..... *B04B 11/02* (2013.01); *B04B 11/04* (2013.01); *B04B 2001/2083* (2013.01)

(58) Field of Classification Search
CPC ..... B04B 2001/2083; B04B 1/12; B04B 1/16; B04B 1/18; B04B 7/14
See application file for complete search history.

(56) References Cited

U.S. PATENT DOCUMENTS 3,799,353 A * 3/1974 Pause ..... B04B 3/00 210/369
3,823,869 A * 7/1974 Loison ..... B04B 1/14 494/56
3,955,758 A * 5/1976 Loison ..... B04B 1/14 494/40
4,392,846 A 7/1983 Novoselac et al.
5,047,004 A * 9/1991 Wells ..... B04B 5/0421 494/17
5,178,602 A * 1/1993 Wells ..... B04B 5/0421 422/548
6,424,067 B1 * 7/2002 Samways ..... B04B 5/005 310/90.5
2015/0190817 A1 * 7/2015 Pieralisi ..... B04B 1/14 494/48

FOREIGN PATENT DOCUMENTS

GB 662451 A * 12/1951 ..... B04B 1/18
GB 973332 A * 10/1964 ..... B01D 37/04
GB 1257110 A 12/1971
GB 1399703 A 7/1975

* cited by examiner

CENTRIFUGAL SEPARATOR OR DECANTER HAVING AN ELECTROMAGNETIC CLOSING SYSTEM

CROSS-REFERENCE TO RELATED U.S. APPLICATIONS

Not applicable.

STATEMENT REGARDING FEDERALLY SPONSORED RESEARCH OR DEVELOPMENT

Not applicable.

NAMES OF PARTIES TO A JOINT RESEARCH AGREEMENT

Not applicable.

REFERENCE TO AN APPENDIX SUBMITTED ON COMPACT DISC

Not applicable.

BACKGROUND OF THE INVENTION

1. Field of the Invention

The present patent application for industrial invention relates to a centrifugal separator with vertical axis of rotation or to a centrifuge with horizontal axis of rotation (decanter) provided with improved closing system.

2. Description of Related Art Including Information Disclosed Under 37 CFR 1.97 and 37 CFR 1.98.

FIG. 1 shows a centrifugal separator according to the prior art, generally indicated with reference number (100). The centrifugal separator (100) comprises a drum (1) mounted on a vertical rotary shaft (10).

A first axial conduit (11) is provided inside the drum (1), defining a distribution chamber. The first axial conduit (11) has a tapered lower end section (12) with downwardly increasing diameter. A second axial conduit (13) is disposed around the first axial conduit (11), being provided with a tapered lower end section (14) with downwardly increasing diameter.

Lamellar disks (15) are provided inside the drum (1), between the tapered sections (12, 14) of the two coaxial conduits, defining a separation area.

The centrifugal separator (100) provides for continuous separation of product (A) in two liquid phases (B, C) with different specific gravity; moreover, it provides for separation of an additional heavier phase (D) (solid sediments).

The product (A) is introduced by falling (or transferred with pump) in the rotary drum through a pipe (2); through the distribution chamber of the first conduit (11) the product reaches the bottom of the drum and is introduced in the separation area formed by the lamellar disks (15). The effect of the centrifugal force together with the presence of said disks (15) creates a separation between phases.

The liquid light phase (B) passes through the lamellar disks (15) and comes out of a first outlet (U1) of the drum, following the direction of arrows (B). The first outlet (U1) is disposed in the upper part of the drum, between the first axial conduit (11) and the second axial conduit (13).

The liquid heavy phase (C) comes out of a second outlet (U2) of the drum, following the direction of arrows (C). The second outlet (U2) is disposed between the second axial conduit (13) and the upper end of the drum (1) at a slightly lower level than the first outlet (U1).

The heavier solid sediments (D) are disposed in a peripheral area of the drum (1) and periodically ejected through a third outlet (U3) obtained in the peripheral part of the drum.

At the end of a work cycle, before the centrifugal separator is stopped, a large quantity of the light phase (B) (which is generally a valuable product, such as oil) remains inside the drum (1), being annularly stratified in the area proximal to the axis of rotation of the drum (1). Similarly, the heavy phase (C) forms the most peripheral layer. Consequently, a large quantity of water must be introduced into the drum (from the inlet of product (A)) in order to make the light phase (B) come out of the first outlet (U1) completely. In fact, water tends to come out with the heavy phase (C) through the second outlet (U2). If a large quantity of water is introduced, water is also able to "move" the light phase (B) towards the outlet (U1). Such a system involves a large waste of water and energy (energy absorbed by the water introduced in the rotary drum and coming out of it at high speed).

In order to solve such drawback caused by the large quantity of water needed, application of a closing device in the second outlet (U2), meaning the heavy phase outlet, is known. Such a closing device is normally open during the work cycle and is closed at the end of the cycle to recover the light phase trapped inside the drum.

Instead, in order to eject the heavier sediment (D), the drum (1) is provided with peripheral holes or slots that are intercepted by a sliding wall (61) (mobile bottom) that rotates together with the drum. In this way the third outlet is opened and closed (U3).

ES8600703, in the name of the same applicant, discloses a vertical centrifugal separator and a decanter, wherein a closing system of the heavy phase outlet is applied both to the vertical centrifugal separator and decanter and a closing system of the heavier sediment outlet is applied only to the vertical centrifugal separator.

The vertical centrifugal separator is provided with two liquid outlets (phases), of which at least one, i.e. the heavy liquid outlet (normally aqueous phase) is of free overflow type. The closing device closes the heavy phase outlet (by means of a "plug") with the machine in operation and permits the complete emission of the valuable liquid (light phase) with the machine in operation, before the necessary intermittent discharge of sediments and the centrifugal feed phase with the recovery of the processing operations. The closing device simplifies the emptying of the light phase from the drum because it uses a very small flow and volume of heavy liquid (normally water) fed through the usual inlet of the process fluid. Otherwise, without closing device, the operation requires a large water flow and volume (with high consumption costs), also impairing the status of the liquid phases separated inside the drum, and consequently the status of the valuable light phase to be discharged, with evident negative consequences. The lack of the closing device also results in high energy consumption to accelerate the large water flow and volume used in the operation.

The horizontal centrifuge (traditional decanter) has liquid outlets, of free overflow type (straight overflow for the light phase and inverted or siphon overflow for the heavy phase). The closing device ("plug") closes the heavy phase outlet to help emptying the light phase (valuable phase) from the drum, according to the same principle illustrated above for the Vertical Centrifuge (by introducing a limited flow and volume of heavy liquid or water). Also in this case, as for the Vertical Centrifuge, the drum can be emptied also without the closing device, but with a considerable amount of water, as already mentioned for the Vertical Centrifuge, with the same negative effects. The closing device is provided with a "normally open" plug that is closed when the device is actuated.

ES2338964 discloses an improved decanter compared to ES8600703, wherein the light phase outlet is obtained in the end flange of the drum and the heavy phase outlet is obtained by means of a radial pipe in association with an obturating disk inside the drum. The disk is situated between the outlets of the two phases in the proximity of said radial pipe. The heavy phase outlet is of inverted overflow type.

Said decanter is provided with a service opening situated in the end flange of the drum in peripheral position with respect to the light phase outlet. A closing device is used to open and close said service opening.

The closing device is normally closed and is opened at the end of the work cycle to discharge and recover the light phase completely through said service opening. Obviously, in such a case, unlike traditional decanters, it is not necessary to introduce a flow and volume of heavy service liquid (normally water) through the service opening, it being simply necessary to open the plug.

EP 1 712 289 discloses a closing device applied to a vertical centrifugal separator that is substantially similar and applicable in the same way as the closing device of ES8600703, but with a different purpose: to wash the interior of the drum for its entire volume, after emptying the valuable light phase from the drum and discharging the sediments. The closing device of the heavy phase is the means that allows for accurate cleaning, feeding the drum with water (or solvent) or fluid for cleaning and rinsing, instead of separation liquid. When the plug is open, the internal parts of the outlet branch of the heavy phase are washed. When the plug is closed, the outlet areas of the light phase, which are difficult to reach without the closing device, are washed. In fact, without the closing device, the consumption of detergent, water and energy would be very high.

The closing systems of the prior art are of hydraulic type (using water as work liquid). The centrifugal pressure of the water is self-generated by the rotation of the drum (by centrifugal force). These hydraulic systems operate when both the inlet product feed flow and the outlet separate products flow are interrupted.

Said hydraulically-controlled closing devices are impaired by several drawbacks. In fact, the closing devices get dirty during the work cycle, not only during activation, but also during the entire separation phase carried out by the centrifugal machine, regardless of being a vertical or horizontal machine.

The service liquid used in the hydraulically-controlled closing device is water. Coupling between fixed and mobile parts of the device is a precision, sliding, watertight coupling. Because of the service water subject to centrifugal force, pressure in the coupling areas is very high and sliding must be guaranteed.

The already separated or centrifuged liquid contains solid sediments, especially in the case of the decanter, which is a rough-processing centrifuge compared to the Centrifugal Separator, but also in the case of a Centrifugal Separator. The service liquid is easily contaminated with the process liquid because they are adjacent. Therefore, solid sediments are rapidly deposited in the sliding areas of the closing device, thus impairing its operation. Frequent cleaning is necessary, although difficult and time consuming, since it requires disassembly the affected parts.

U.S. Pat. No. 2,218,532 discloses a centrifugal separator comprising an electromagnet connected to a valve to open/close an opening disposed in the lower part of the drum to discharge solid sediments.

The purpose of the present invention is to eliminate the drawbacks of the prior art, disclosing a centrifugal separator or decanter provided with a closing system to close/open the liquid heavy phase outlet that is efficient, effective and reliable.

Another purpose is to disclose a centrifugal separator provided with a closing system to open/close the solid sediments outlet that is efficient, effective and reliable.

Another purpose of the present invention is to provide such a closing device that is simple to make and install and capable of minimizing maintenance operations.

BRIEF SUMMARY OF THE INVENTION

The centrifugal separator or decanter according to the invention comprises:

- a rotary drum in which the product is introduced in order to be separated at least in a light phase and a heavy phase,
- a first light phase outlet,
- a second heavy phase outlet, and
- a closing device adapted to close/open said second heavy phase outlet and/or a third solid sediments outlet.

The closing device comprises an electromagnetic actuator.

In spite of being composed of a fixed part and a mobile part, the electromagnetic actuator does not need to have the same precision feature between the two parts as the hydraulic device of the prior art. The mutual centering of the parts is exclusively required for balancing, not sealing reasons. Therefore, with the electromagnetic actuator according to the invention, it is simply necessary to adopt criteria that allow for draining the dirty liquids contained in the working area of the actuator. In conclusion, the operation of such a closing device is not affected by dirtying.

Advantageously, the electromagnetic actuator provides for a coil disposed on a fixed part of the machine. Therefore, said electromagnetic actuator does not have any electrical power problems, because the only electrical part of the device is the coil disposed on a fixed part of the machine. The mobile part of the electromagnetic actuator, which interacts with the coil, is simply made of ferromagnetic material and connected to the rotary drum.

BRIEF DESCRIPTION OF THE DRAWINGS

Further characteristics of the invention will appear clearer from the detailed description below, which refers to merely illustrative, not limitative, embodiments, illustrated in the attached drawings, wherein.

DETAILED DESCRIPTION OF THE INVENTION

Referring now to FIGS. 2 to 5, a first embodiment of a vertical centrifugal separator according to the invention is described, generally indicated with reference number (100). Hereinafter elements that are identical or similar to the ones described above are indicated with the same reference numbers, omitting their detailed description.

Figure 1:
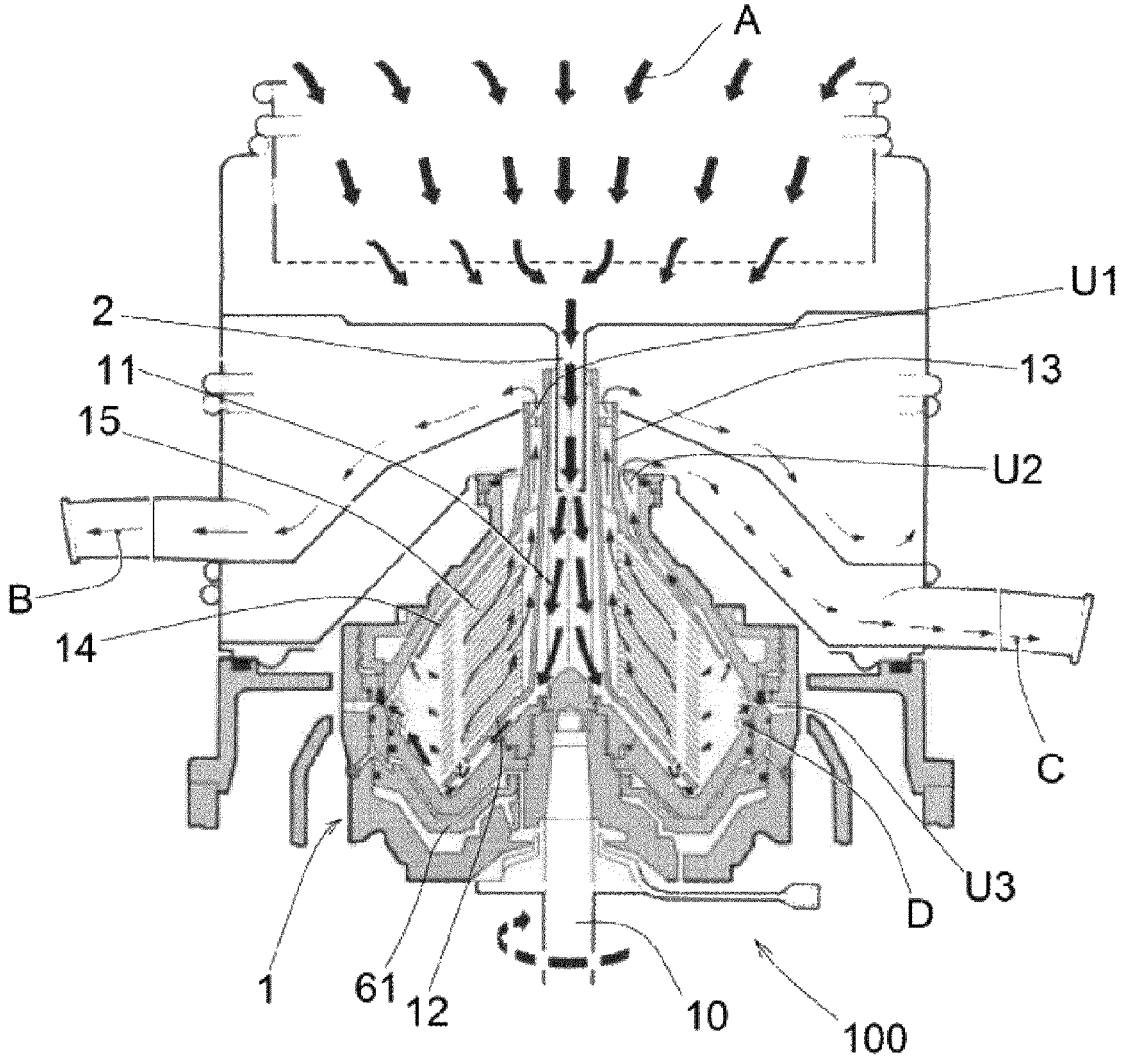
FIG. 1 PRIOR ART
FIG. 1 is an axial sectional view of a vertical centrifugal separator according to the prior art.
Figure 2:
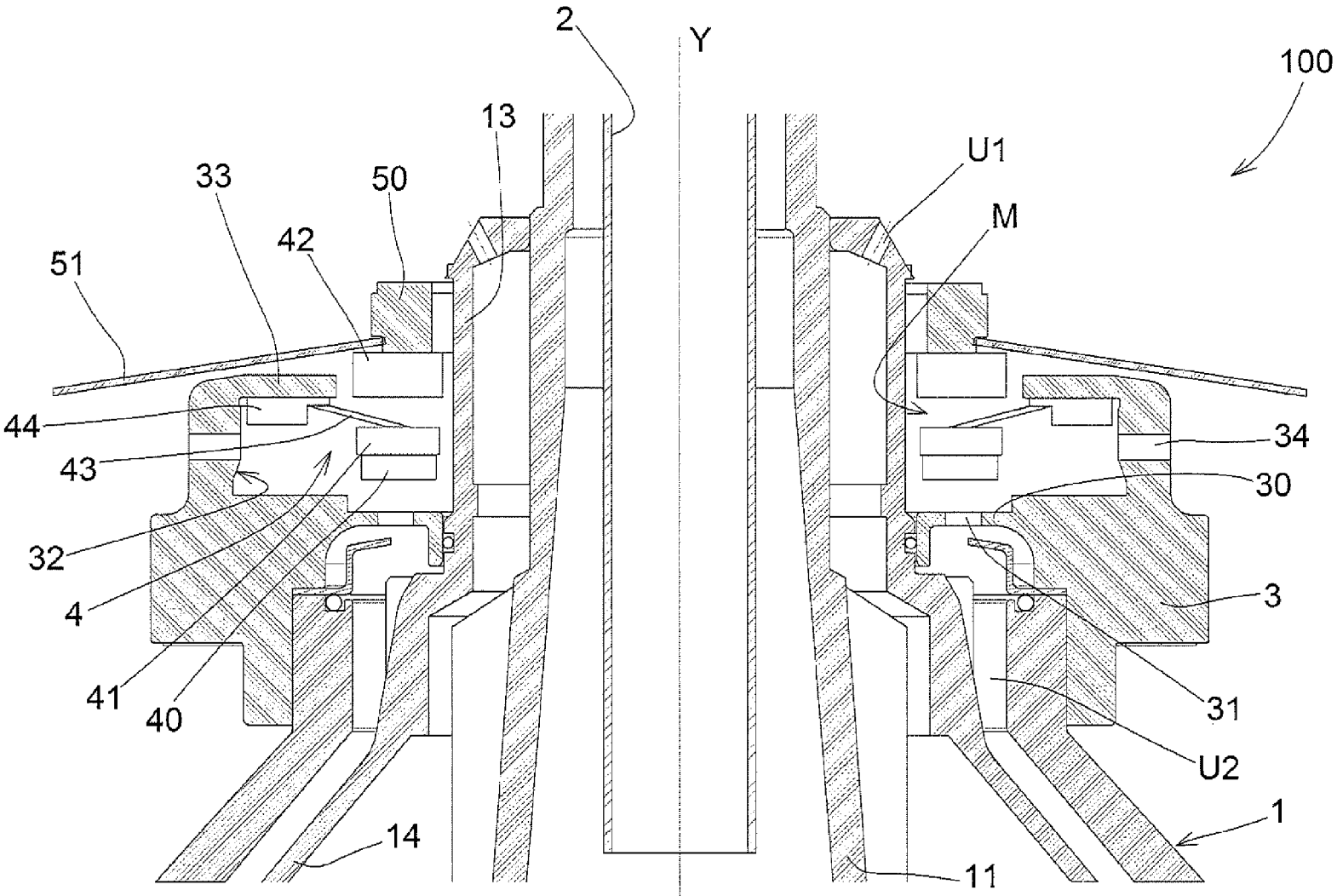
FIG. 2 is an axial sectional view of a portion of a vertical centrifugal separator according to the present invention, with the closing device of the heavy phase in open position.

Referring to FIG. 2, the centrifugal separator (100) comprises a drum (1) revolvingly mounted with respect to a vertical axis (Y). A first conduit (11) and a second conduit (13) are coaxially disposed inside the drum (1) in such manner to define a first outlet (U1) between the first conduit (11) and an upper part of the second conduit (13) and a second outlet (U2) between the second conduit (13) and an upper part of the drum (1). The second outlet (U2) is disposed in lower peripheral position with respect to the first outlet (U1). Consequently, the first outlet (U1) is used for the light phase and the second outlet (U2) is used for the heavy phase.

A collar (3) is fixed in the upper part of the drum (1) and provided with an annular flange (30) that protrudes internally to close the outlet (U2) of the heavy phase. The annular flange (30) is provided with holes (31) in communication with the outlet (U2) of the heavy phase. The overflow level of the heavy phase is determined by the so-called "adjustment" ring, which is interchangeable with rings of different diameters, disposed between the annular flange (30) and the output (U2) of the heavy phase.

The collar (3) is provided with a recessed seat (32) defined by an upper wall (33) disposed at a certain distance from the second conduit (13) that protrudes in upper position from the drum (1). The seat (32) of the collar is shaped as a "C" and disposed above the annular flange (30). The collar is provided with radial holes (34) in communication with the seat (32).

A closing device, generally referred to with number (4), is provided in the seat (32) of the collar. The closing device (4) comprises a plug (40) and actuation means (M) to actuate the plug (40).

The plug (40) is adapted to close the holes (31) of the collar in communication with the outlet (U2) of the heavy phase. The plug (40) is shaped as an annular plate and made of suitable material to guarantee tightness, such as rubber.

According to the invention, the actuation means (M) comprise an electromagnetic actuator (M) to actuate the plug (40) and open or close the outlet (U2) of the heavy phase.

The electromagnetic actuator (M) comprises a ferromagnetic element (41) directly connected to the plug (40) and an electromagnetic coil (42) mounted on a fixed support (50) connected to a fixed structure (51) of the machine.

Figure 3:
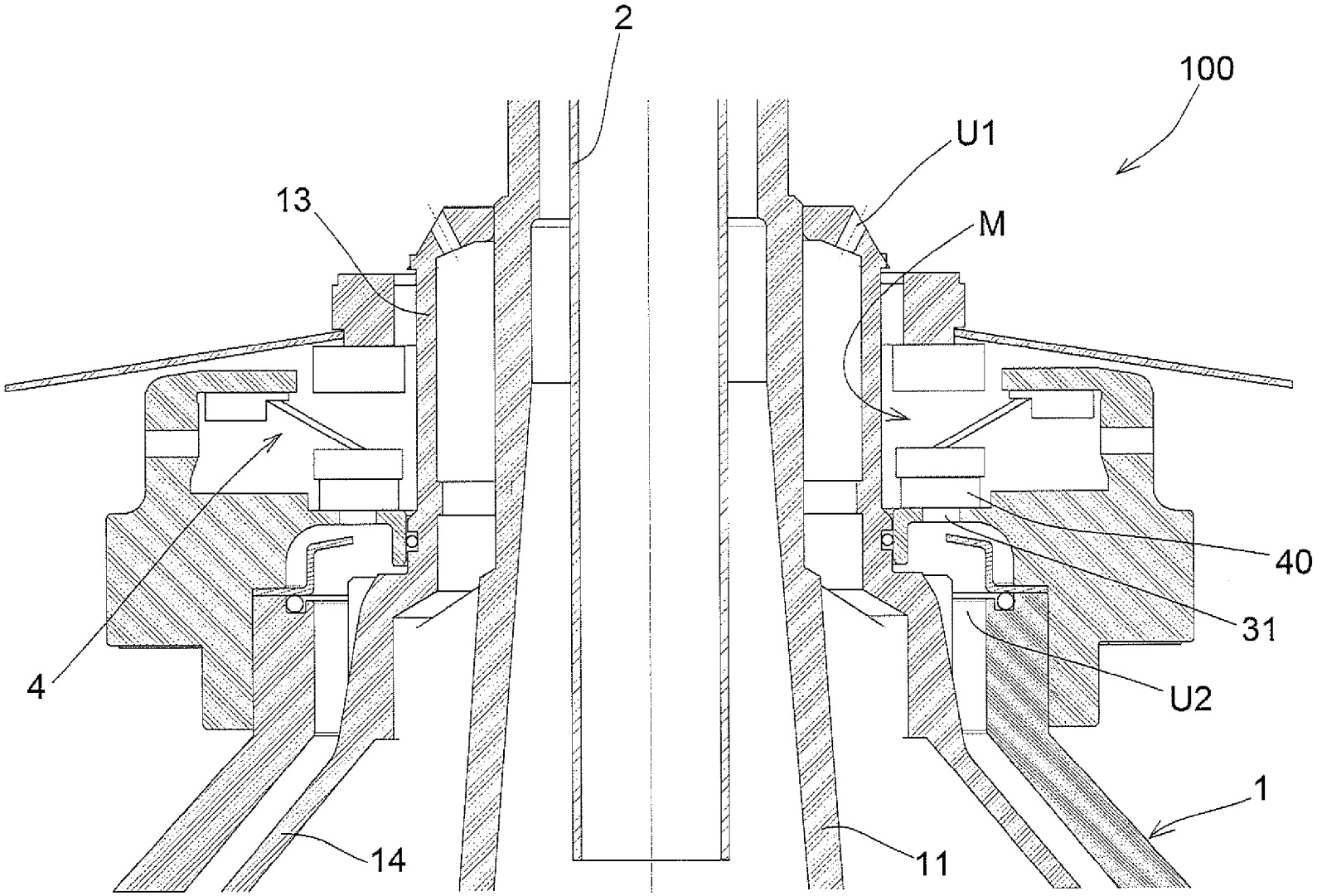
FIG. 3 is the same view as FIG. 2, except for the closing device of the heavy phase in closed position.

The closing device (4) is normally open with excited coil; when the coil (42) is excited, the plug (40) is at a certain distance from the flange (30), thus allowing the heavy phase to come out of the holes (31). Instead, when the coil (42) is not excited, no magnetic field is generated and the spring (43) pushes the ferromagnetic element (41) towards the flange (30) in such manner that the plug closes the holes (31), as shown in FIG. 3.

The ferromagnetic element (41) and plug (40) assembly is maintained in closed position by springs means (43). The spring means (43) are preferably a cup spring with a first end connected to the ferromagnetic element (41) and a second end connected to a support (44) fixed to the upper wall (33) of the collar. In this way, when the coil (42) is excited, the magnetic force pushes the ferromagnetic element (41) overcoming the resistance of the spring (43). Instead, when the coil is not excited, the plug (40) returns to the closing position because of the elastic return of the spring (43).

Figure 4:
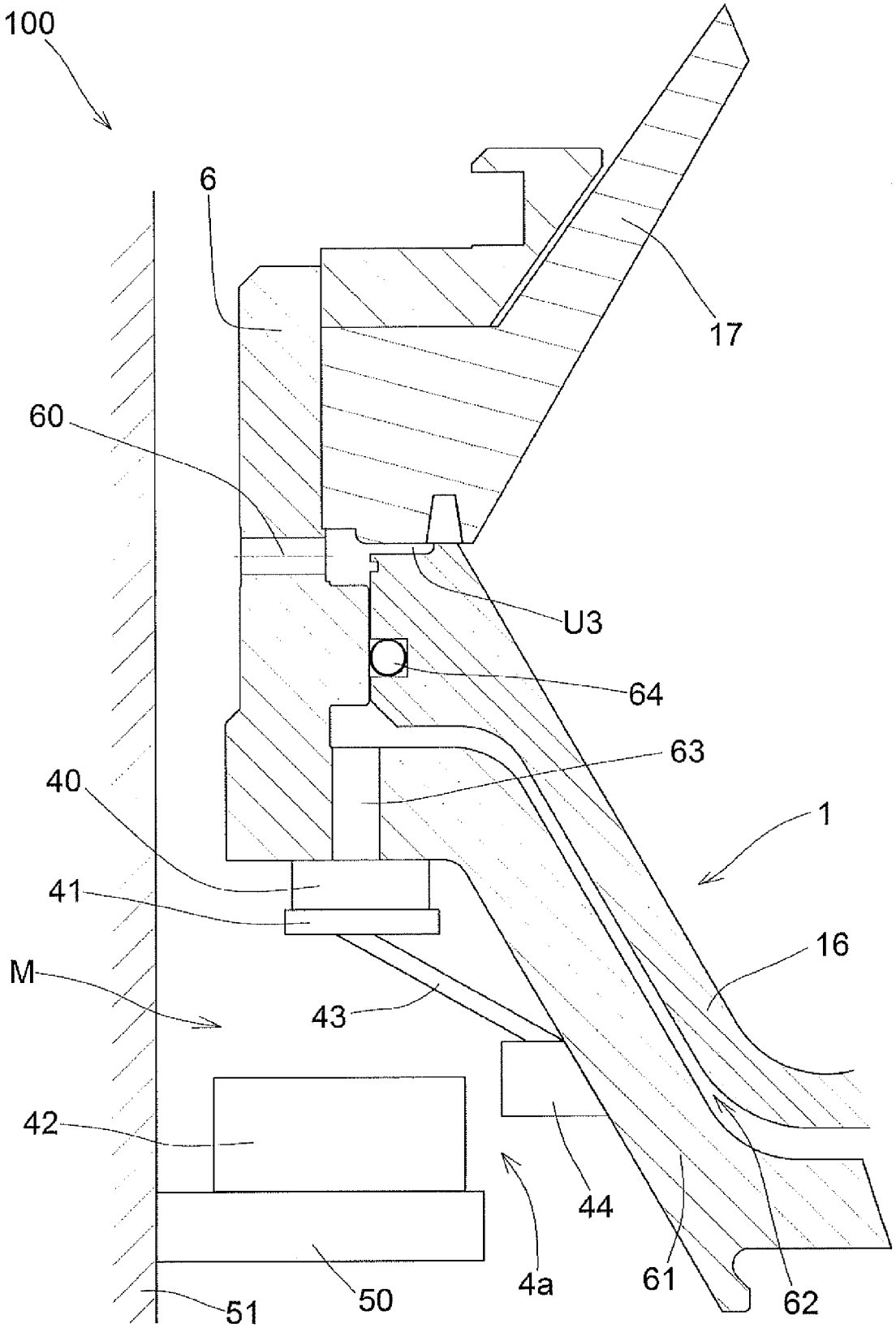
FIG. 4 is an axial sectional view of a portion of a vertical centrifugal separator according to the present invention, with closing device of solid sediments in closed position.
Figure 5:
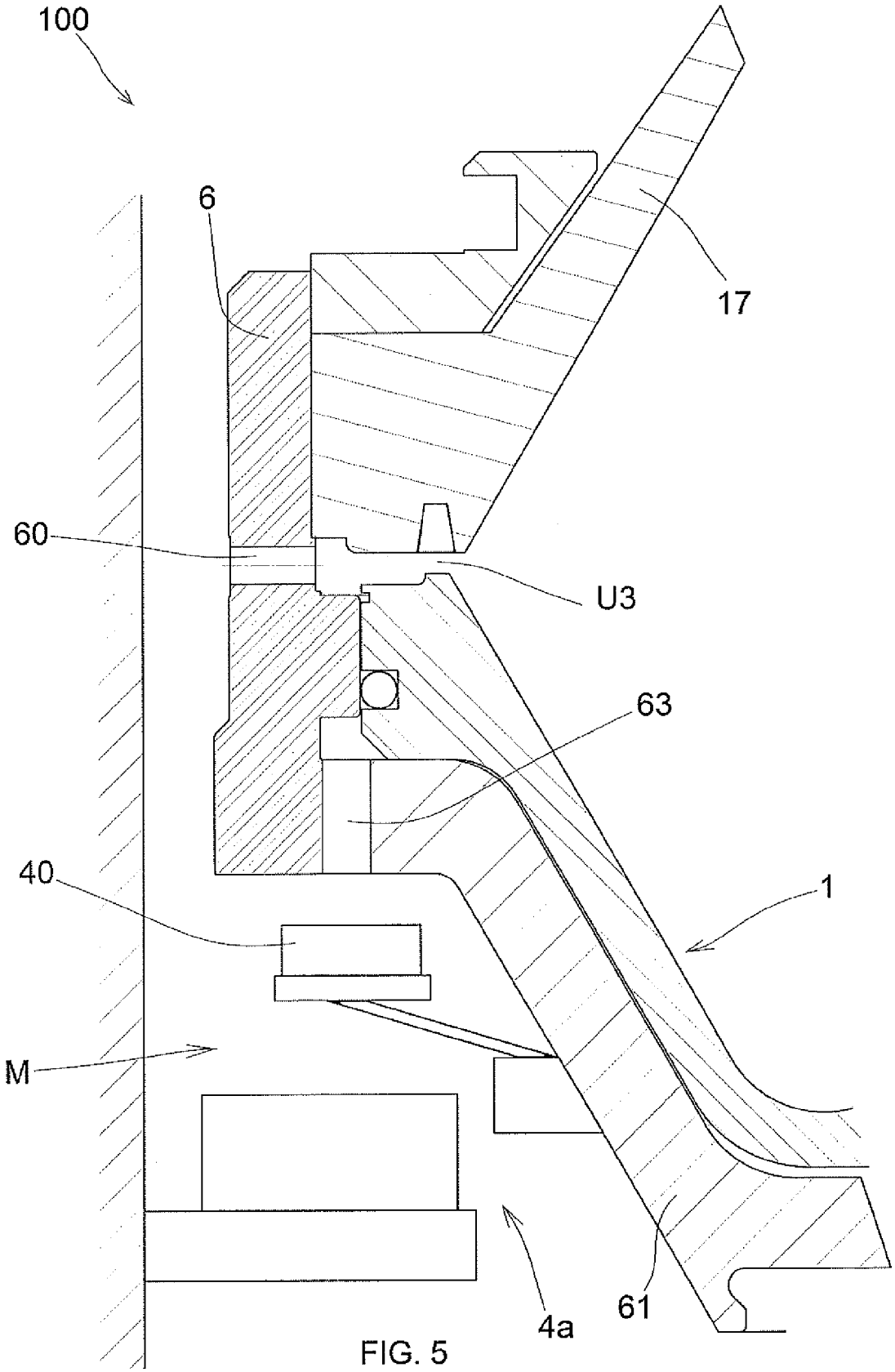
FIG. 5 is the same view as FIG. 4, except for the closing device of solid sediments in open position.

FIG. 4 illustrates a peripheral portion of the drum (1) wherein solid sediments is deposited. In this case, the drum (1) comprises a mobile bottom (16) and an upper part (17) in mutual contact to close an outlet (U3) of the solid sediments. The mobile bottom (16) moves with respect to the upper part (17) in order to open the outlet (U3) of the solid sediments, as shown in FIG. 5.

A tubular end (6) of the drum, to which the upper part (17) of the drum is fixed, is provided with holes (60) in correspondence of the outlet (U3) to let the solid sediments come out. The tubular end (6) continues with a lower section (61) parallel to the mobile bottom (16) of the drum, in such manner to generate an air space (62) between the mobile bottom (16) of the drum and the lower portion (61) of the tubular end (6).

The air space (62) is in communication with vertical holes (63). On the contrary, the air space (62) is not in communication with holes (60) because of a gasket (64) disposed between the mobile bottom (16) of the drum and the lower portion (61) of the same drum.

The air space (62) is used for the hydraulic actuation of the mobile bottom (16) of the drum. In fact, when the air space (62) is filled with water, pressure is generated by centrifugal force and the mobile bottom (16) of the drum is stopped against the upper part (17) of the drum, thus closing the outlet (U3) of the solid sediment. Instead, when water is emptied from the air space (62) (FIG. 5), the mobile bottom (16) of the drum is lowered by means of the internal pressure generated by the fluid in centrifugation inside the drum and is detached from the upper part (17) of the drum, thus opening the outlet (U3) of the solid sediments.

In such a case, the closing device (4*a*) is disposed under the drum (1) and the plugs (40) close the holes (63) to discharge water.

Therefore, the closing device (4*a*) is normally closed (FIG. 4) during the operation of the machine and is opened (FIG. 5) only periodically to discharge solid sediments.

Consequently, when the coil (42) is excited, it generates a magnetic field that attracts the ferromagnetic element (41) against the force of the spring (43), thus opening the holes (63) and discharging the water.

Figure 6:
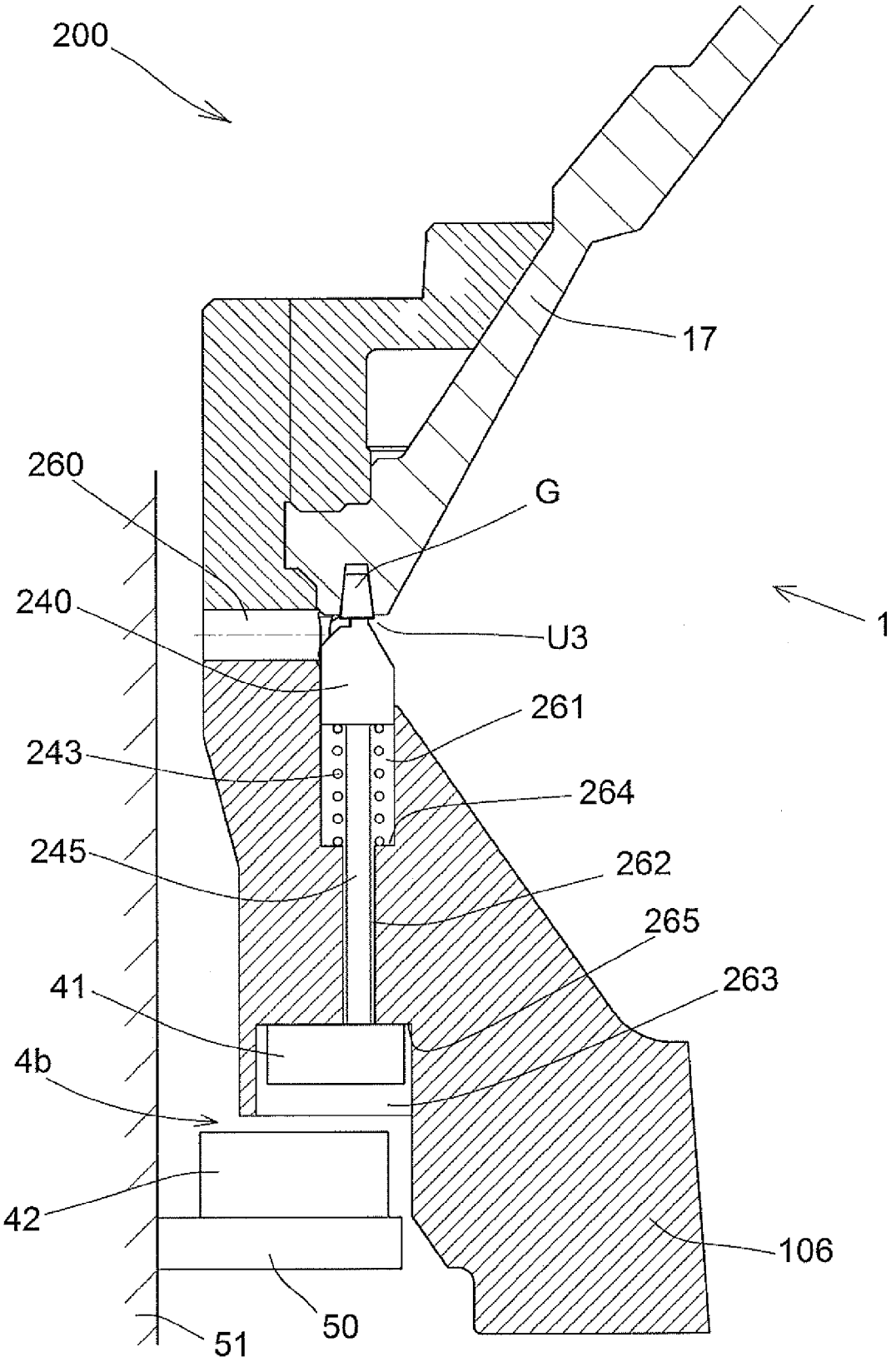
FIGS. 6 and 7 are the same views as FIGS. 4 and 5, except for they show a variant of the closing device.
Figure 7:
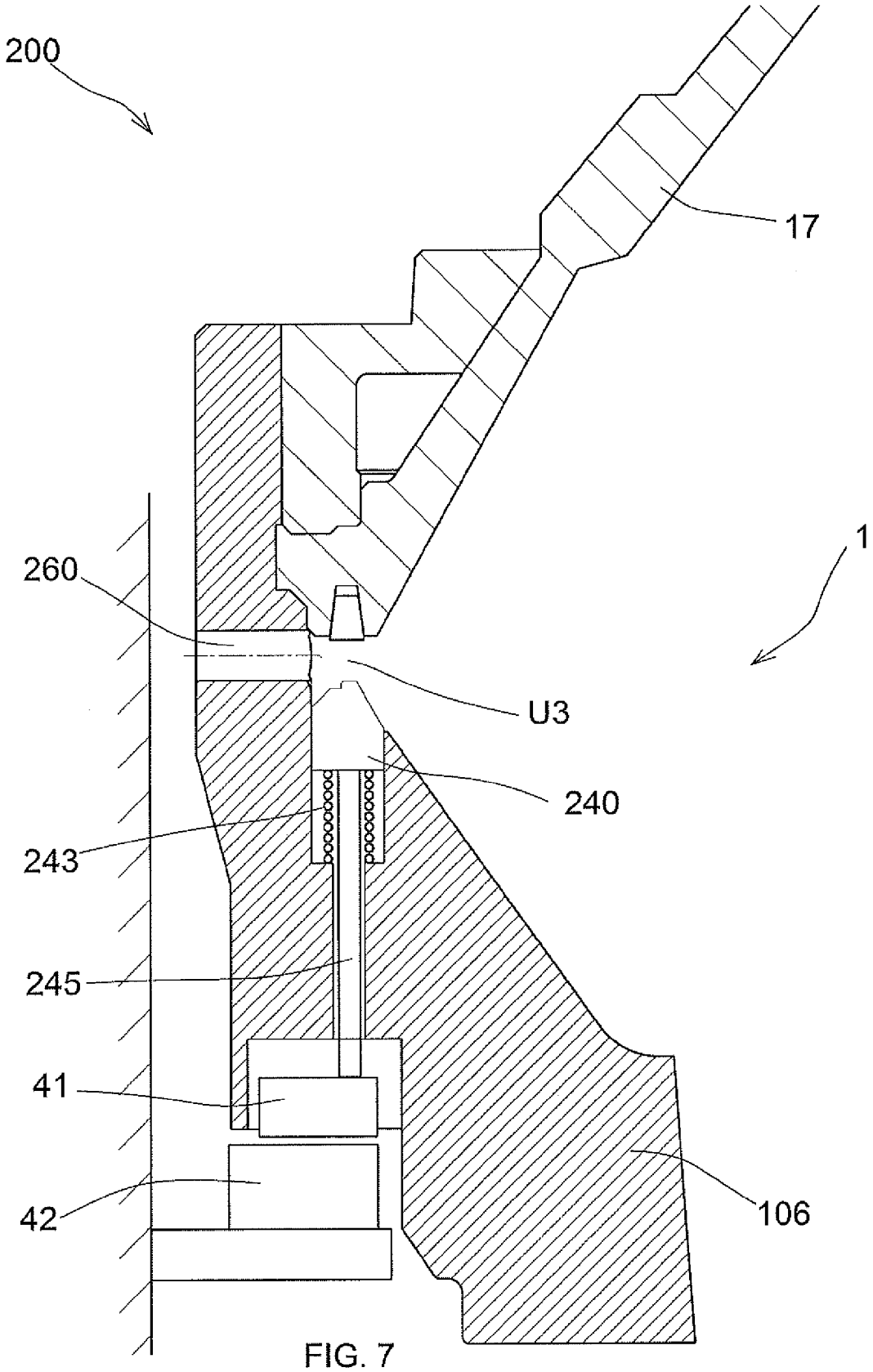

FIGS. 6 and 7 disclose a second embodiment of a centrifugal separator with vertical axis (200), wherein the hydraulic actuation of the outlet (U3) of solid sediments has been eliminated. In such a case, the drum (1) comprises an upper part (17) and a lower part (106) that are mutually joined and form an outlet (U3) of solid sediments.

The lower part (106) of the drum is provided with holes (260) in communication with the outlet (U3) to discharge solid sediments.

Moreover, the lower part (106) comprises:

an upper annular seat (261) open on top, a lower annular seat (263) open on the bottom; and a plurality of vertical holes (262) providing communication between the two seats (261, 263).

In this way a first stop surface (264) is generated between the upper annular seat (261) and the vertical holes (262) and a second stop surface (265) is generated between the lower annular seat (263) and the vertical holes (262).

In this case, the shape of the closing device (4*b*) is slightly different from the closing device (4*a*) of FIGS. 4 and 5.

In fact, the closing device (4*b*) comprises an annular plug (240) connected to the annular ferromagnetic element (41) by means of a plurality of stems (245).

The plug (240) slides in the upper annular seat (261) and stops against a gasket (G) disposed in the upper part (17) of the drum, in correspondence of the outlet (U3) of solid sediment.

The stems (245) slide in the vertical holes (262) and the ferromagnetic element (41) slides in the lower annular seat (263). A series of helicoidal springs (243) is disposed in the upper annular seat (261), one spring for each stem (262). In view of the above, each helicoidal spring (243) has a first end stopped against the stop surface (264) and a second end stopped against the plug (240), thus stressing the plug in closed position.

The coil (42) is disposed under the ferromagnetic element (41) and supported by a fixed support (50). So, when the coil (42) attracts the ferromagnetic element (41), the outlet (U3) of the solid sediments is opened, as shown in FIG. 7.

Figure 8:
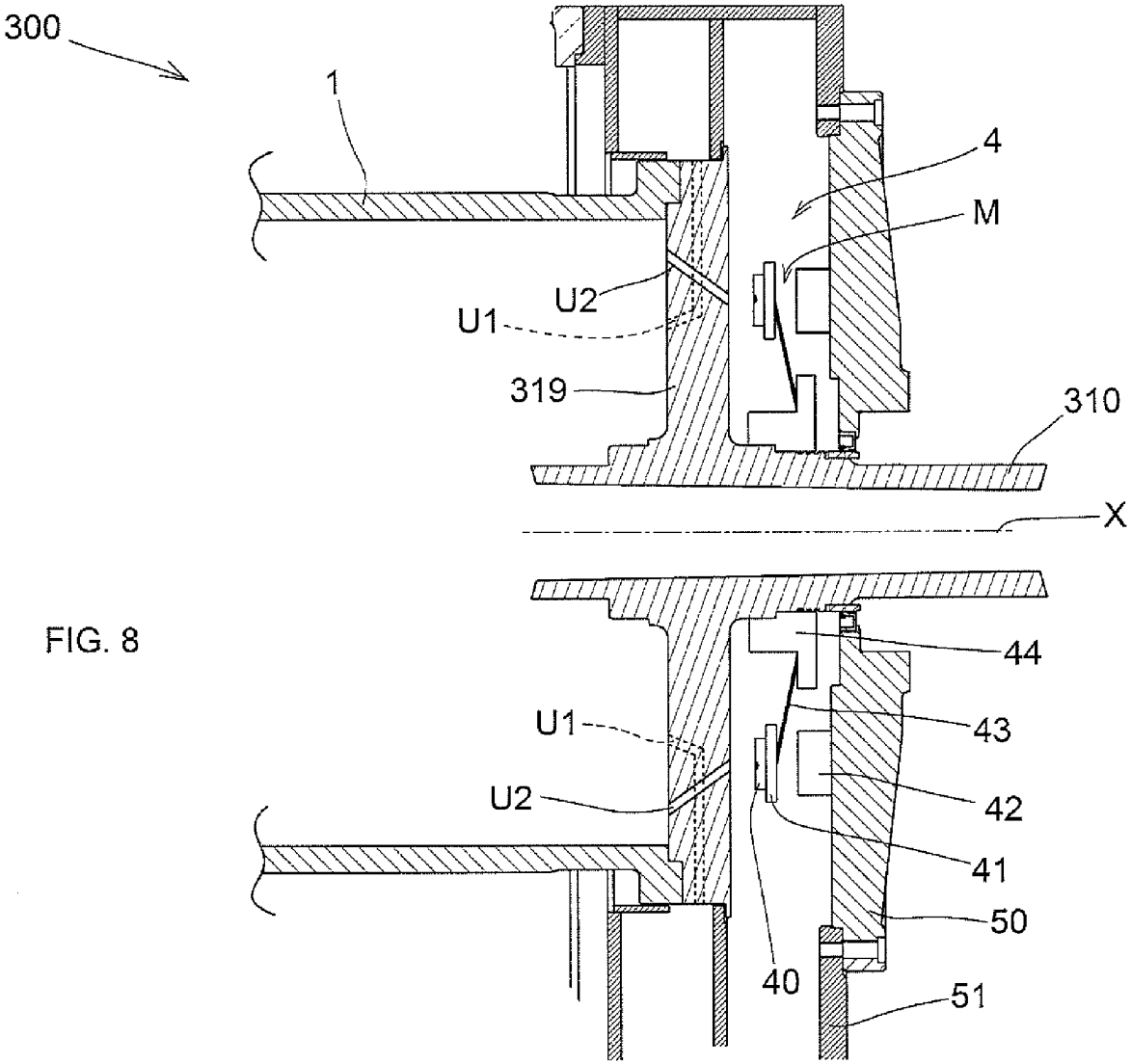
FIG. 8 is an axial sectional view of a portion of a horizontal centrifuge or decanter according to the present invention, with closing device of the heavy phase in open position.
Figure 9:
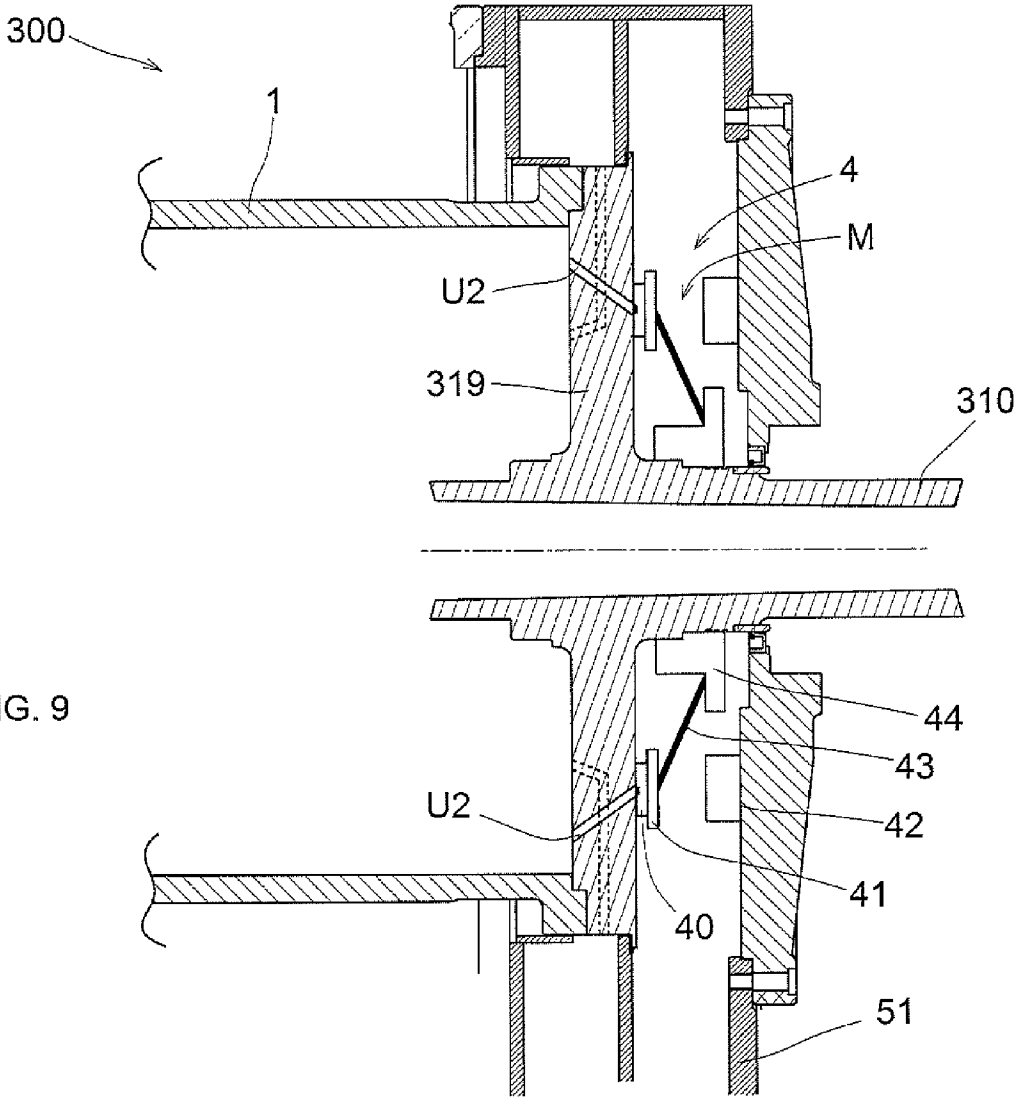
FIG. 9 is the same view as FIG. 8, except for the closing device of the heavy phase in closed position.

FIGS. 8 and 9 disclose a decanter (300) comprising a drum (1) revolvingly mounted with respect to a horizontal axis (X). The drum (1) is composed of a (possibly hollow) rotary shaft (310) provided with a flange (319) fixed to the drum.

The flange (319) is provided with outlet holes of the light phase (U1) and outlet holes of the heavy phase (U2) disposed in peripheral position with respect to the ones of the light phase (U1). The outlet holes of the light phase (U1) are of straight overflow type, in communication with the internal part of the drum that is closer to the axis of the drum; whereas the outlet holes of the heavy phase (U2) are of inverted overflow type in order to act as siphon in the peripheral part of the drum. The outlet holes of the light and heavy phase (U1; U2) are in communication with separate collection chambers.

In such a case, the closing device (4) is mounted on the rotary shaft (310) in external position on the drum (1). The support (44) of the cup spring (43) is a collar mounted on the shaft (310). The spring (43) supports the ferromagnetic element (41) whereon the plug (40) is mounted to open and close the outlet of the heavy phase (U2). The electromagnetic coil (42) is mounted on a support (50) fixed to the fixed structure (51) of the machine.

The plug (40) is normally open (FIG. 8) when the coil (42) is electrically powered. When the coil (42) is not electrically powered, the ferromagnetic element (41) is pushed together with the plug (40) towards the outlet holes of the heavy phase (U2) because of the spring (43).

Figure 10:
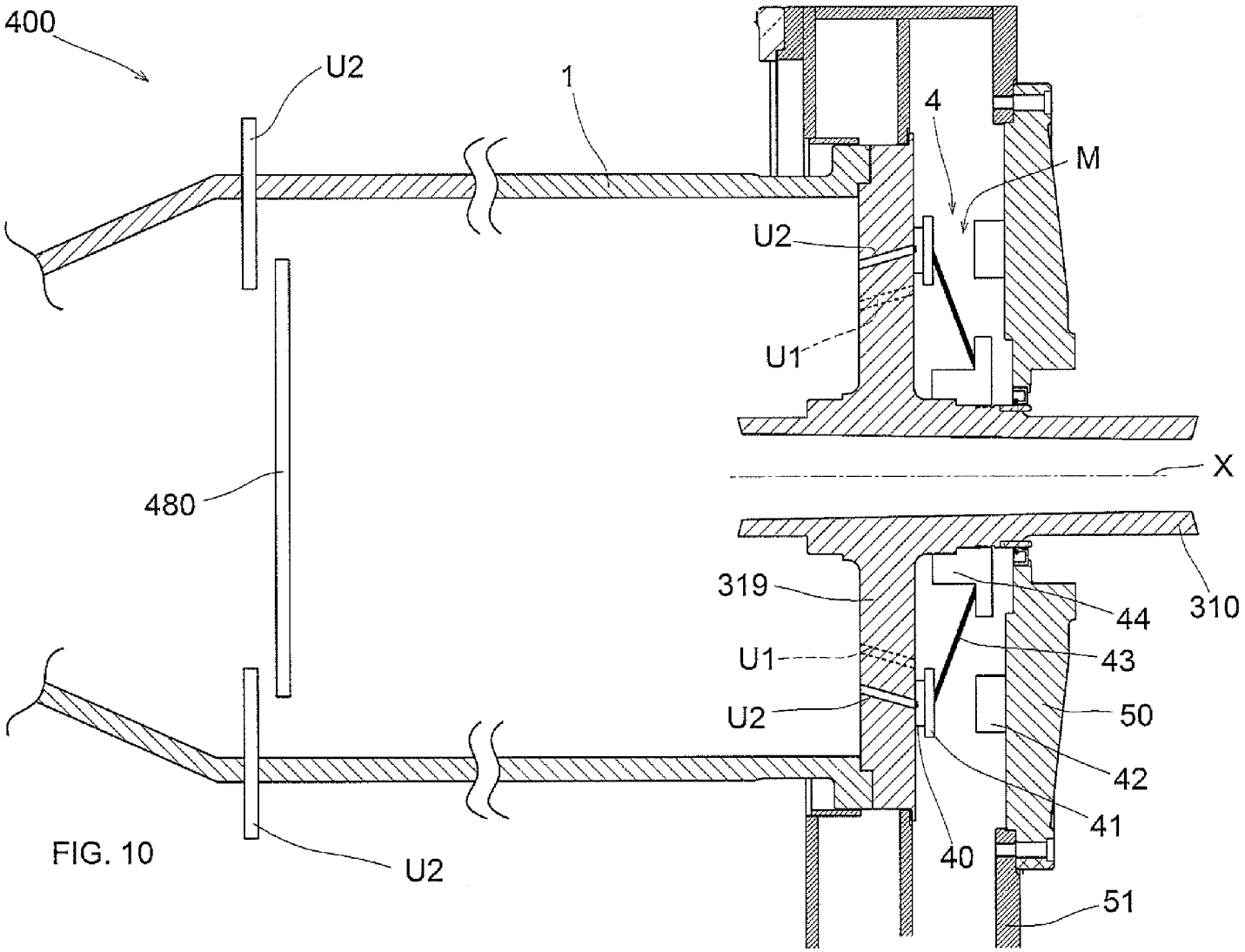
FIG. 10 is an axial sectional view of a portion of a horizontal centrifuge or improved decanter, with closing device according to the present invention applied to a service outlet and shown in closed position.
Figure 11:
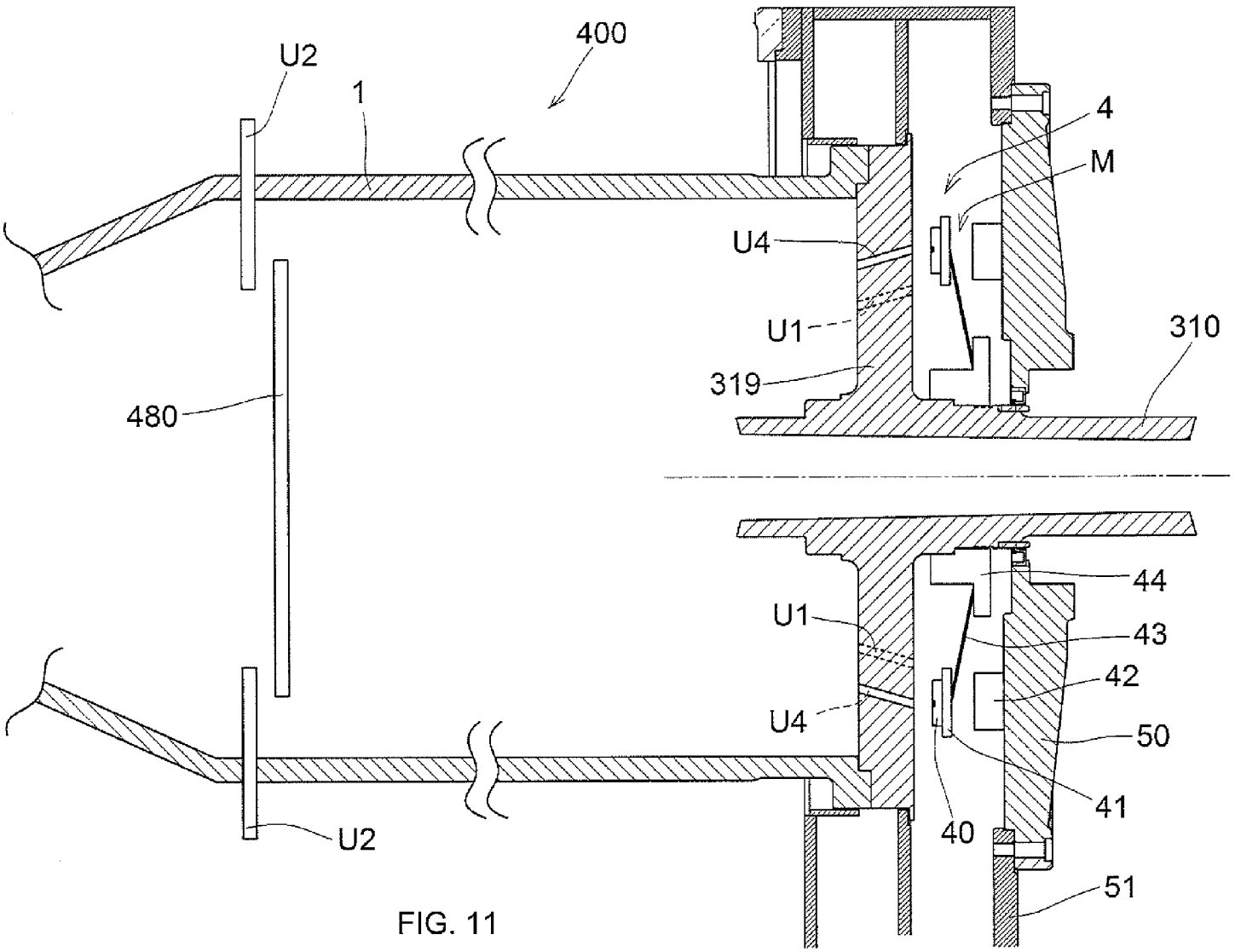
FIG. 11 is the same view as FIG. 10, except for the closing device of the service outlet in open position.

FIGS. 10 and 11 disclose an improved decanter (400) provided with outlet holes of the light phase (U1) on the flange (319) connected to the rotary shaft (310).

If any, the outlet of the heavy phase (U2) is obtained by means of a radial pipe in association with an obturating disk (480) inside the drum, disposed immediately upstream said pipe in the outlet flow.

Said decanter (400) is provided with a service opening (U4) situated in the end flange of the drum, in peripheral position with respect to the outlet of the light phase (U1). The closing device (4) is applied to the service outlet (U4) in order to open and close said service outlet.

The closing device (4) is normally closed (FIG. 10) during the process and is opened (FIG. 11) to empty the light phase without the need to introduce water.

Referring to FIGS. 10 and 11, if the outlet of the heavy phase (U2) is not provided, although the obturating disk (480) is provided, a two-phase decanter is obtained. A two-phase decanter is provided with two outlets:

an outlet (U1) of the liquid light phase, and an outlet of the solid phase that is discharged through a screw inside the drum. As it is known, in a two-phase decanter, the outlet of the solid phase also includes the liquid of the heavy phase, meaning that oil pomace (coming out from the solid phase outlet) has higher humidity than the oil pomace of the three-phase decanter illustrated in FIGS. 10 and 11.

Figure 12:
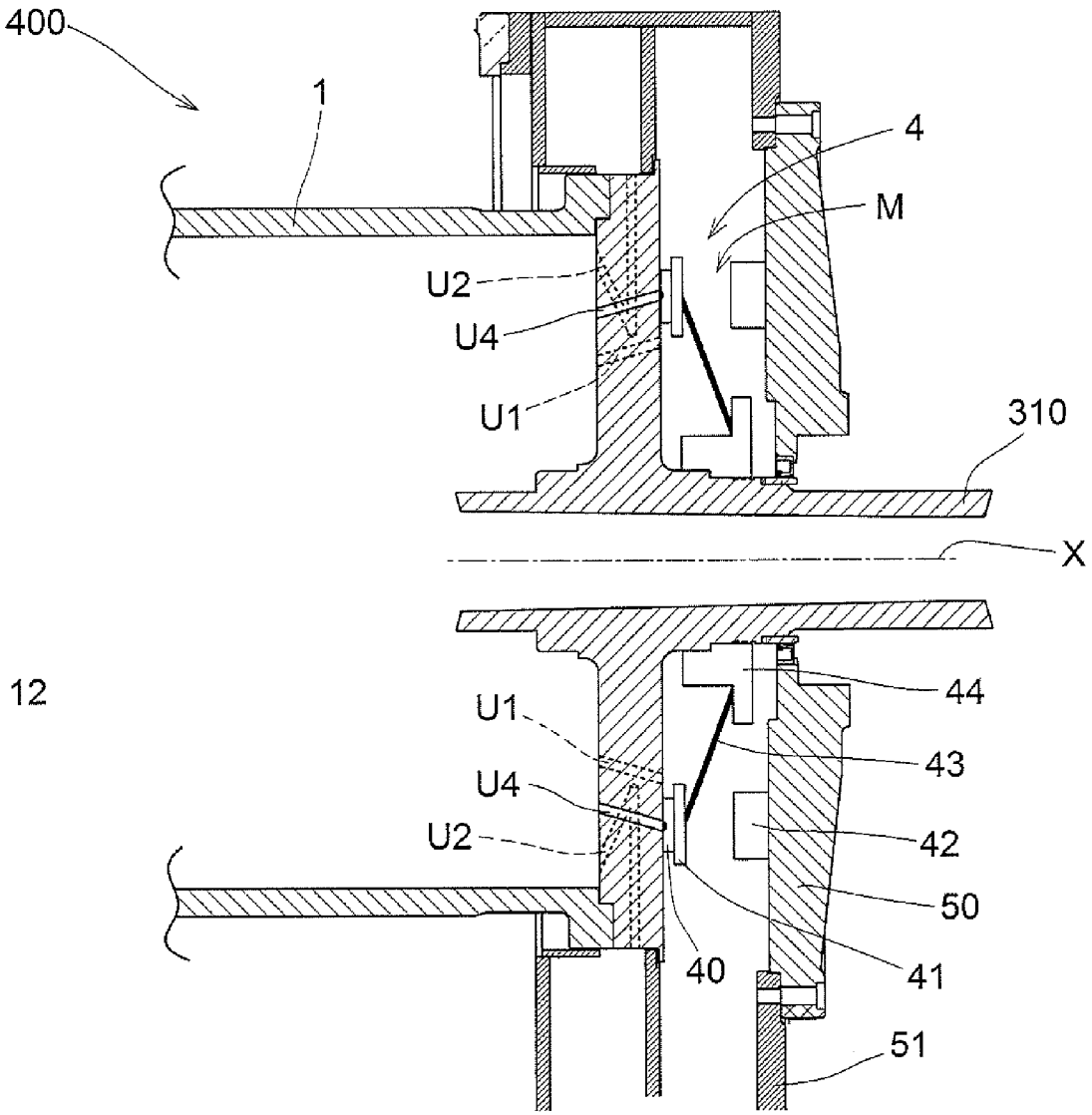
FIGS. 12 and 13 are the same views as FIGS. 10 and 11, except for they show a variant of the improved decanter of FIGS. 10 and 11.
Figure 13:
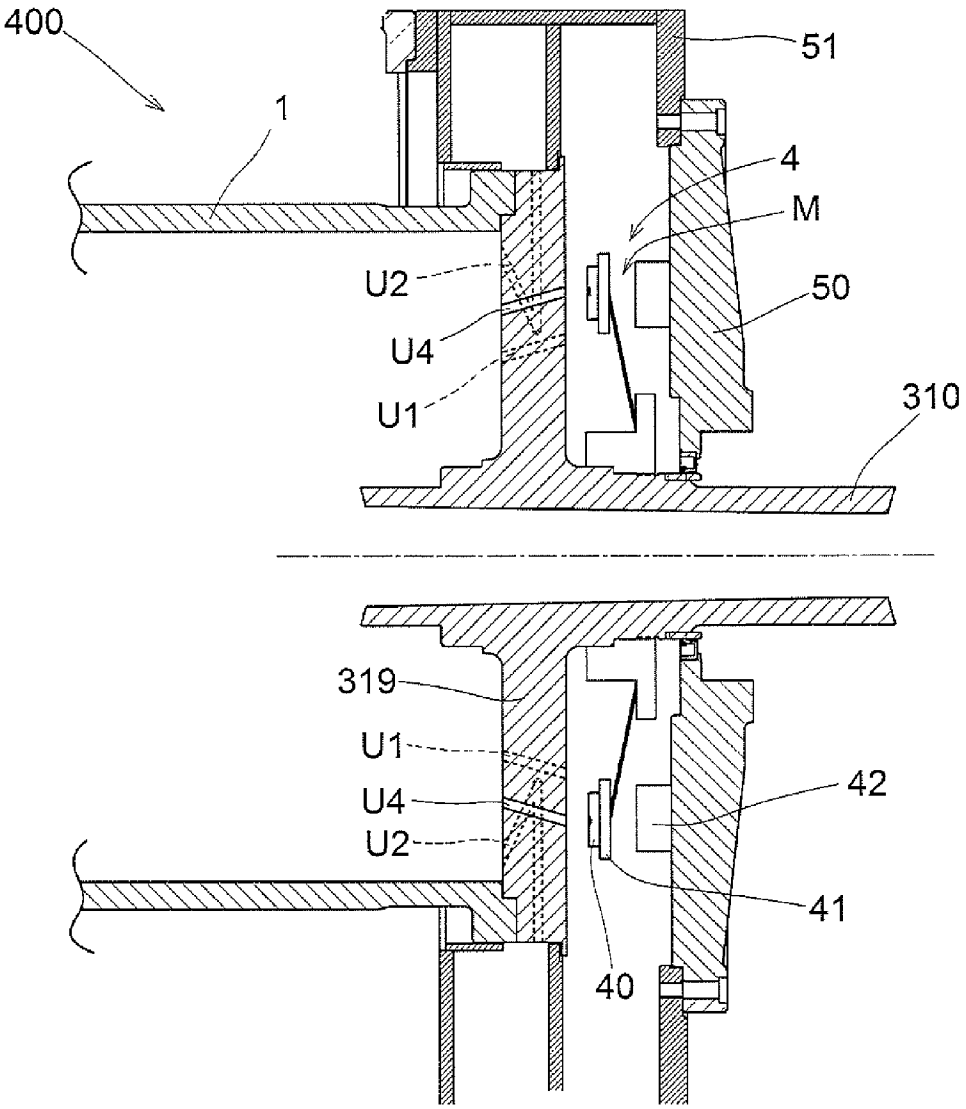

FIGS. 12 and 13 illustrate a different version compared to FIGS. 10 and 11, wherein the outlet of the heavy phase (U2) is not obtained by means of the radial pipe, but with holes obtained on the flange (319) joined to the rotary shaft (310) in peripheral position with respect to the service outlet (U4).

Numerous variations and modifications can be made to the present embodiments of the invention, within the reach of an expert of the field, while still falling within the scope of the invention described in the enclosed claims.

The invention claimed is:

1. A centrifugal separator or decanter comprising:

a rotary drum that is adapted to receive a product that is to be separated at least into a light phase and a heavy phase and solid sediments;

a first outlet for the light phase;

a closing device that opens or closes a second outlet for the heavy phase or a service outlet of the light phase or a third outlet for the solid sediments, said closing device comprising:

an electromagnetic actuator having a ferromagnetic element whereon a closing plug is mounted and an electromagnetic coil that creates a magnetic field when powered so as to attract the ferromagnetic element; and a spring connected to said closing plug so as to urge said closing plug to a closed position, said electromagnetic coil being mounted on a support connected to a fixed structure, said closing plug and said ferromagnetic element and said spring being connected to said rotary drum, said spring comprising:

a cup spring having a truncated conical shape.

2. A centrifugal separator or decanter comprising:

a rotary drum that is adapted to receive a product that is to be separated at least into a light phase and a heavy phase and solid sediments;

a first outlet for the light phase;

a closing device that opens or closes a second outlet for the heavy phase or a service outlet of the light phase or a third outlet for the solid sediments, said closing device comprising:

an electromagnetic actuator having a ferromagnetic element whereon a closing plug is mounted and an electromagnetic coil that creates a magnetic field when powered so as to attract the ferromagnetic element;

a spring connected to said closing plug so as to urge said closing plug to a closed position, said electromagnetic coil being mounted on a support connected to a fixed structure, said closing plug and said ferromagnetic element and spring being connected to said rotary drum; and a collar disposed at an upper end of said rotary drum, said collar comprising holes in communication with said second outlet and an annular seat wherein said closing device is disposed such that said closing plug can open or close the holes of said collar.

3. The centrifugal separator or decanter of claim 2, said rotary drum comprising:

a mobile bottom and an upper part that are mutually joined, said mobile bottom being mobile with respect to said upper part in such manner to define said third outlet in a peripheral portion of said rotary drum; and a lower portion disposed around said mobile bottom to define an air space adapted to be filled with water to move said mobile bottom towards said upper part and to close said third outlet, said lower portion comprising outlet holes in communication with said air space so as to let water out in order to move said mobile bottom away from said upper part and to open said third outlet, wherein said closing device is disposed under said lower section in such manner to close or open said outlet holes.

4. The centrifugal separator or decanter of claim 2, wherein said rotary drum comprises a lower part and an upper part that are mutually joined, said third outlet being in a peripheral portion of said rotary drum between said upper part and said lower part.

5. The centrifugal separator or decanter of claim 4, wherein said closing plug is connected to said ferromagnetic element by a plurality of stems sliding in holes formed in said lower part of said rotary drum, wherein helicoidal springs are cooperative with said plurality of stems.

6. A centrifugal separator or decanter comprising:

a rotary drum that is adapted to receive a product that is to be separated at least into a light phase and a heavy phase and solid sediments;

a first outlet for the light phase;

a closing device that opens or closes a second outlet for the heavy phase or a service outlet of the light phase or a third outlet for the solid sediments, said closing device comprising:

an electromagnetic actuator having a ferromagnetic element whereon a closing plug is mounted and an electromagnetic coil that creates a magnetic field when powered so as to attract the ferromagnetic element;

a spring connected to said closing plug so as to urge said closing plug to a closed position, said electromagnetic coil being mounted on a support connected to a fixed structure, said closing plug and said ferromagnetic element and spring being connected to said rotary drum; and a rotary shaft provided with a flange fixed to said rotary drum, wherein said second outlet is in said flange, said ferromagnetic element connected to said rotary shaft.

7. The centrifugal separator or decanter of claim 6, said flange having said first output and said service output disposed in a peripheral position with respect to the first output, wherein said closing device is applied to said service outlet.

* * * * *